US012102246B2

(12) United States Patent
Boscarino et al.

(10) Patent No.: US 12,102,246 B2
(45) Date of Patent: Oct. 1, 2024

(54) WEARABLE TRAY

(71) Applicant: Port-A-Tray, Incorporated, Barrington, IL (US)

(72) Inventors: Nick S. Boscarino, Barrington, IL (US); Thomas J. Gilmore, Hodgkins, IL (US); Edward Mark Harris, Crystal Lake, IL (US)

(73) Assignee: Port-A-Tray, Incorporated, Barrington, IL (US)

( * ) Notice: Subject to any disclaimer, the term of this patent is extended or adjusted under 35 U.S.C. 154(b) by 311 days.

(21) Appl. No.: 17/592,112

(22) Filed: Feb. 3, 2022

(65) Prior Publication Data

US 2023/0240462 A1 Aug. 3, 2023

(51) Int. Cl.
*A47G 23/06* (2006.01)

(52) U.S. Cl.
CPC .. *A47G 23/0641* (2013.01); *A47G 2023/0675* (2013.01)

(58) Field of Classification Search
CPC ..... A47B 23/002; A47G 23/0641; A47G 2023/0675; F16M 13/04; B65D 11/182; B65D 11/1833; B65D 88/52
USPC ..... 224/148.7
See application file for complete search history.

(56) References Cited

U.S. PATENT DOCUMENTS

| | | | | |
|---|---|---|---|---|
| 372,496 | A | 11/1887 | Small | |
| 2,265,690 | A | 9/1941 | Fiedler | |
| 3,009,613 | A | 11/1961 | Noland | |
| 3,541,976 | A | 11/1970 | Rozas | |
| 4,013,254 | A * | 3/1977 | Boundy | A47B 96/1416 248/221.12 |
| 4,114,199 | A | 9/1978 | Malan | |
| 4,887,315 | A | 12/1989 | Bezdek | |
| 4,887,874 | A * | 12/1989 | Joffe | A47B 88/941 312/258 |
| 4,915,278 | A | 4/1990 | Smith | |
| 5,074,222 | A | 12/1991 | Welch | |
| 5,642,674 | A | 7/1997 | Joye, Sr. et al. | |
| 6,116,166 | A * | 9/2000 | Rotstein | B60N 2/2839 108/135 |
| 6,457,421 | B1 | 1/2002 | Apichom | |

(Continued)

FOREIGN PATENT DOCUMENTS

| | | |
|---|---|---|
| EP | 2853181 | 4/2015 |
| FR | 2900556 | 11/2007 |
| IT | 20180005189 | 11/2019 |

OTHER PUBLICATIONS

International Search Report and Written Opinion of the International Searching Authority for PCT application No. PCT/US2023/11717, dated Apr. 26, 2023.

*Primary Examiner* — Adam J Waggenspack
(74) *Attorney, Agent, or Firm* — Erickson Law Group, PC

(57) ABSTRACT

A wearable tray is disclosed. The tray has a base, a back wall, and a first sidewall and second sidewall. The base has a front portion and a rear portion. The front portion is connected to the rear portion. The front portion is moveable between an extended position and a retracted position. The back wall is connected to the base. The first sidewall is connected to the base. The second sidewall is connected to the base opposite the first sidewall. A neck strap is connectable to the first sidewall and the second sidewall.

20 Claims, 18 Drawing Sheets

(56) References Cited

U.S. PATENT DOCUMENTS

| | | | | |
|---|---|---|---|---|
| 6,419,333 | B2 * | 7/2002 | Liebertz | A47B 88/941 312/348.4 |
| 7,806,305 | B1 | 10/2010 | Moore, Jr. et al. | |
| 8,091,486 | B1 | 1/2012 | Broaddrick | |
| 8,157,137 | B1 | 4/2012 | Laird | |
| 8,807,406 | B1 | 8/2014 | Thach | |
| 9,516,941 | B1 | 12/2016 | Moulton | |
| 10,660,426 | B2 | 5/2020 | Norman et al. | |
| 11,503,903 | B2 * | 11/2022 | Haddy | A47B 3/083 |
| 2011/0127190 | A1 | 6/2011 | Bardwell et al. | |
| 2017/0127811 | A1 | 5/2017 | Young | |
| 2017/0265632 | A1 * | 9/2017 | Johnson | A45F 3/005 |
| 2021/0274928 | A1 * | 9/2021 | Hanks | A47B 23/041 |

* cited by examiner

WEARABLE TRAY

FIELD OF THE INVENTION

This invention relates in general to a tray that is wearable by a person.

BACKGROUND OF THE INVENTION

A tray can be used to support items. The present inventors recognized the need for a human wearable tray that has a base for supporting items that can extend or retract to accommodate a user's varying needs for more or less support space. The present inventors recognized the need for a wearable tray that can be moved between two or more configurations depending on the needs of the user.

SUMMARY OF THE INVENTION

A wearable tray is disclosed. The tray has a base, a back wall, and a first and second sidewalls. The base has a hinge, a tray front portion, and a tray rear portion. The front portion is connected to the rear portion. The front portion is moveable between an extended position and a retracted position. The back wall is connected to the base. The first sidewall is connected to the base. The second sidewall is connected to the base opposite the first sidewall. A neck strap is connectable to the first sidewall and the second sidewall.

Numerous other advantages and features of the present invention will become readily apparent from the following detailed description of the invention and the embodiments thereof, from the claims, and from the accompanying drawings.

DETAILED DESCRIPTION

The following description is presented to enable any person skilled in the art to make and use the invention. For the purposes of explanation, specific nomenclature is set forth to provide a plural understanding of the present invention. While this invention is susceptible of embodiment in many different forms, this description describes and the drawings show specific embodiments of the invention with the understanding that the present disclosure is to be considered as an exemplification of the principles of the invention and is not intended to limit the invention to the specific embodiments illustrated.

Figure 1:
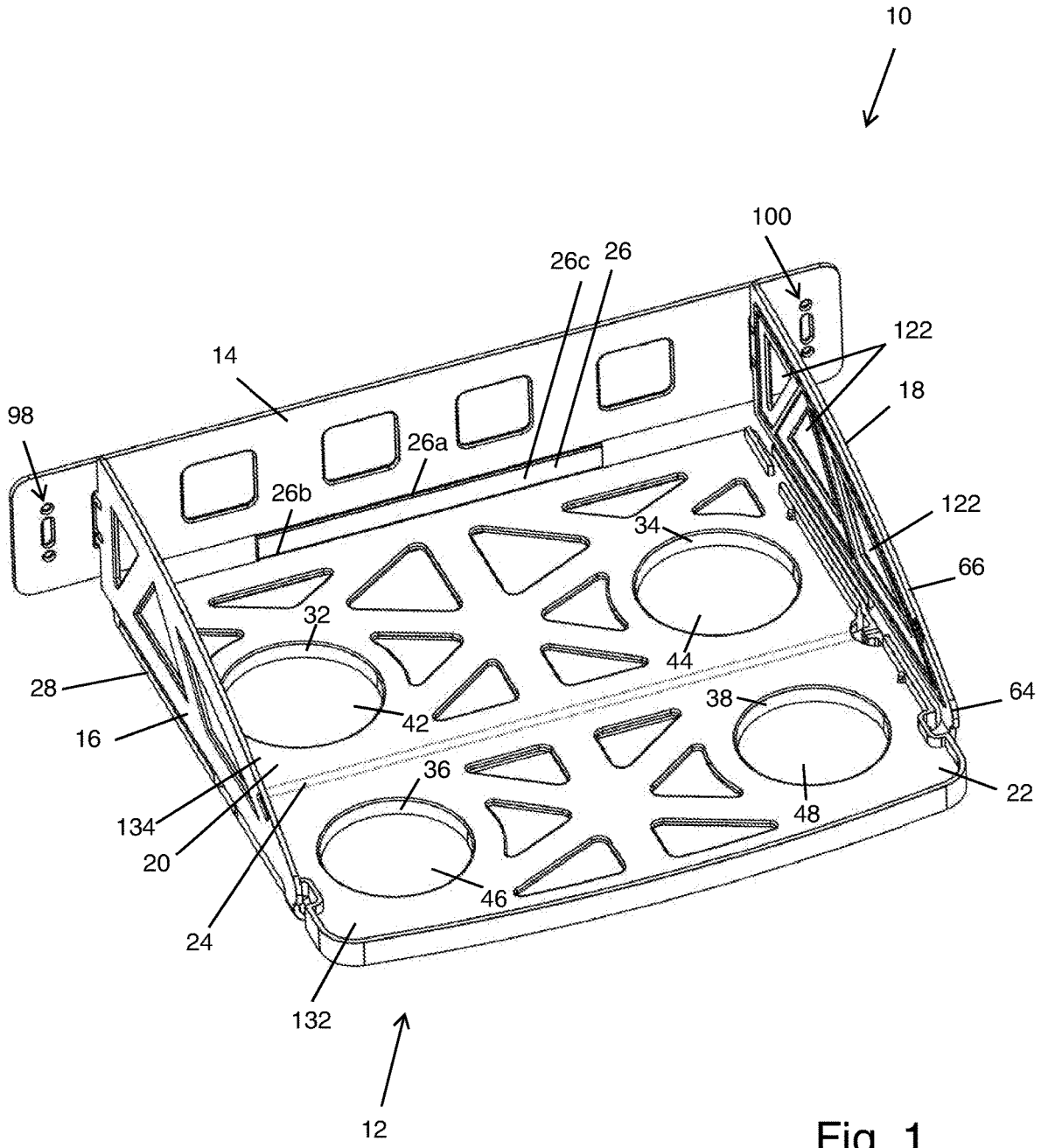
FIG. 1 is a perspective view of an embodiment of a wearable tray of the invention in a deployed configuration.
Figure 2:
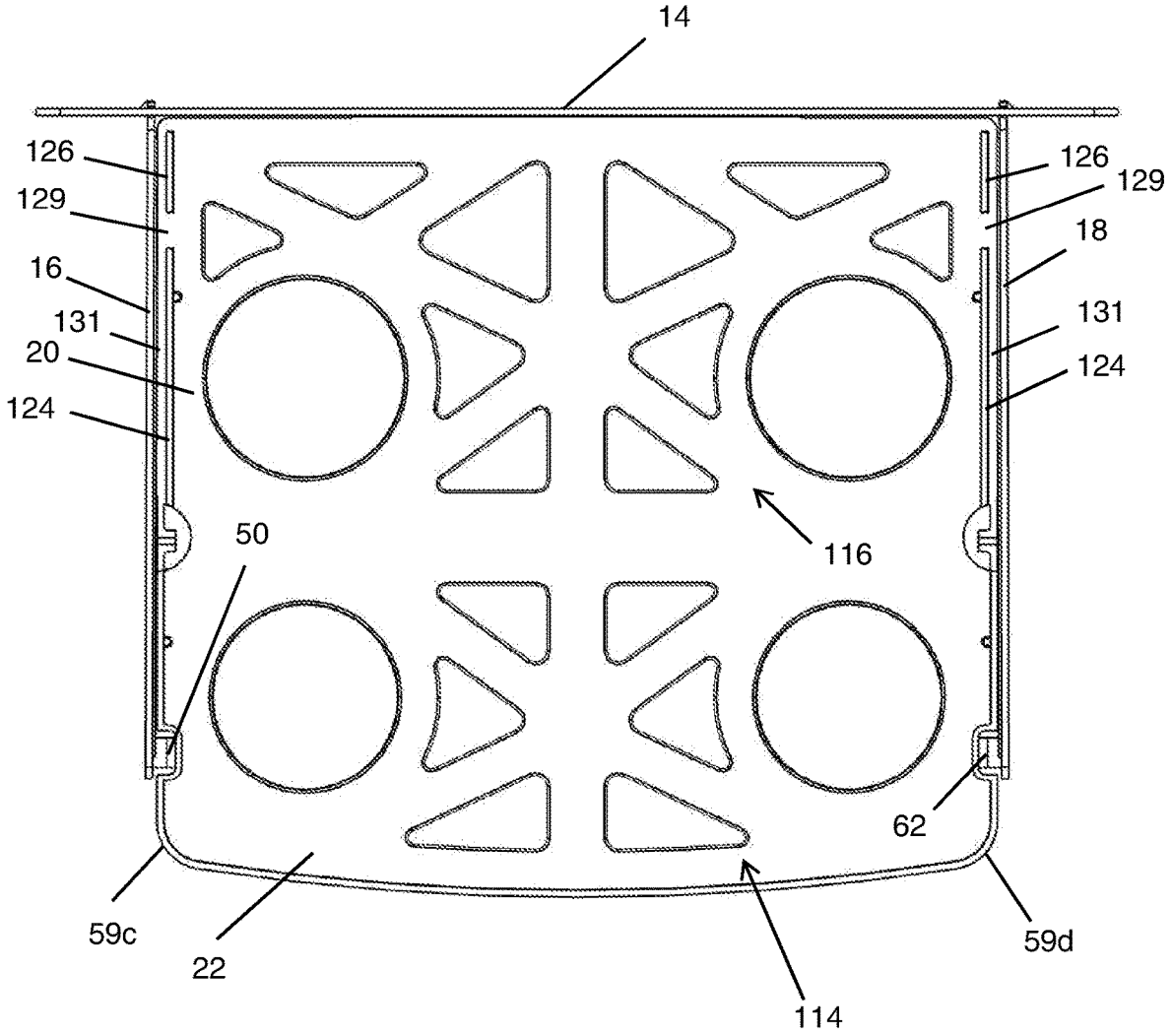
FIG. 2 is a top view of the tray of FIG. 1.
Figure 2A:
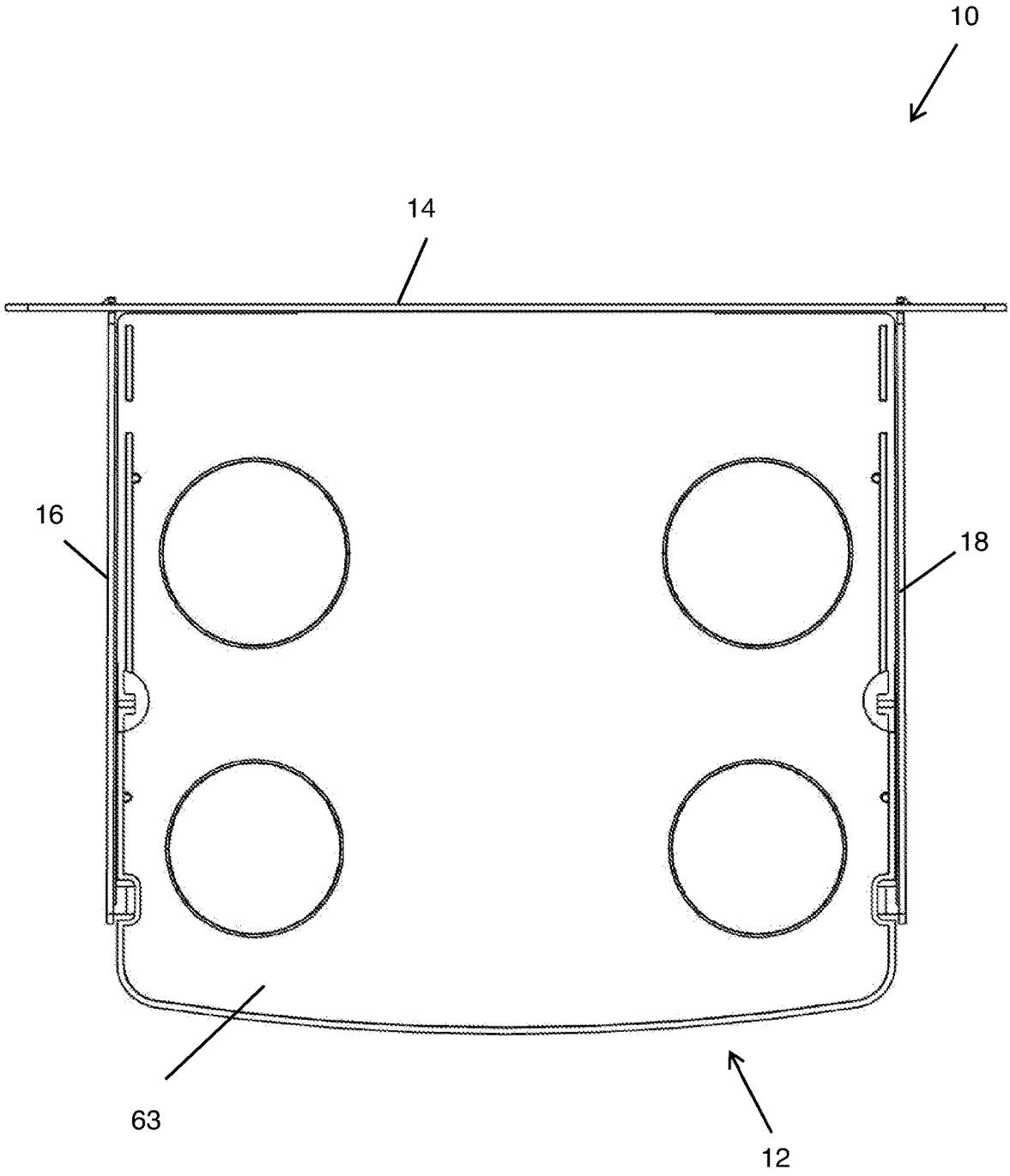
FIG. 2A is a top view of the tray of FIG. 1 where a cover is shown.

FIG. 1 shows an embodiment of a wearable tray 10. The tray comprises a base 12, a back wall 14, a first sidewall 16, and a second sidewall 18. The base 12 comprises a tray rear portion 20 and a tray front portion 22. The tray comprises a deployed configuration shown in FIGS. 1 to 7, a compact configuration shown in FIGS. 8 to 11, and released configuration shown in FIG. 22. The base 12, and correspondingly the rear and front portions 20, 22, provide an upper tray or support surface 132, 134 for supporting items at or adjacent the wearer. Such items may include food, beverages, personal articles, and/or other articles. In some embodiments, the back wall 14 and the side walls 16, 18 are relatively thin plates as shown in FIG. 2, however other thickness can be used.

A hinge 24 connects the rear and front portions 20, 22 of the base 12. In some embodiments, the hinge 24 is a living hinge or an integral hinge that is a flexible hinge made from the same material as the rear and front portions it connects. In some embodiments, the living hinge can be thinned, scored, or cut to allow rigid rear and front portions 20, 22 to bend along the line of the hinge.

Figure 3:
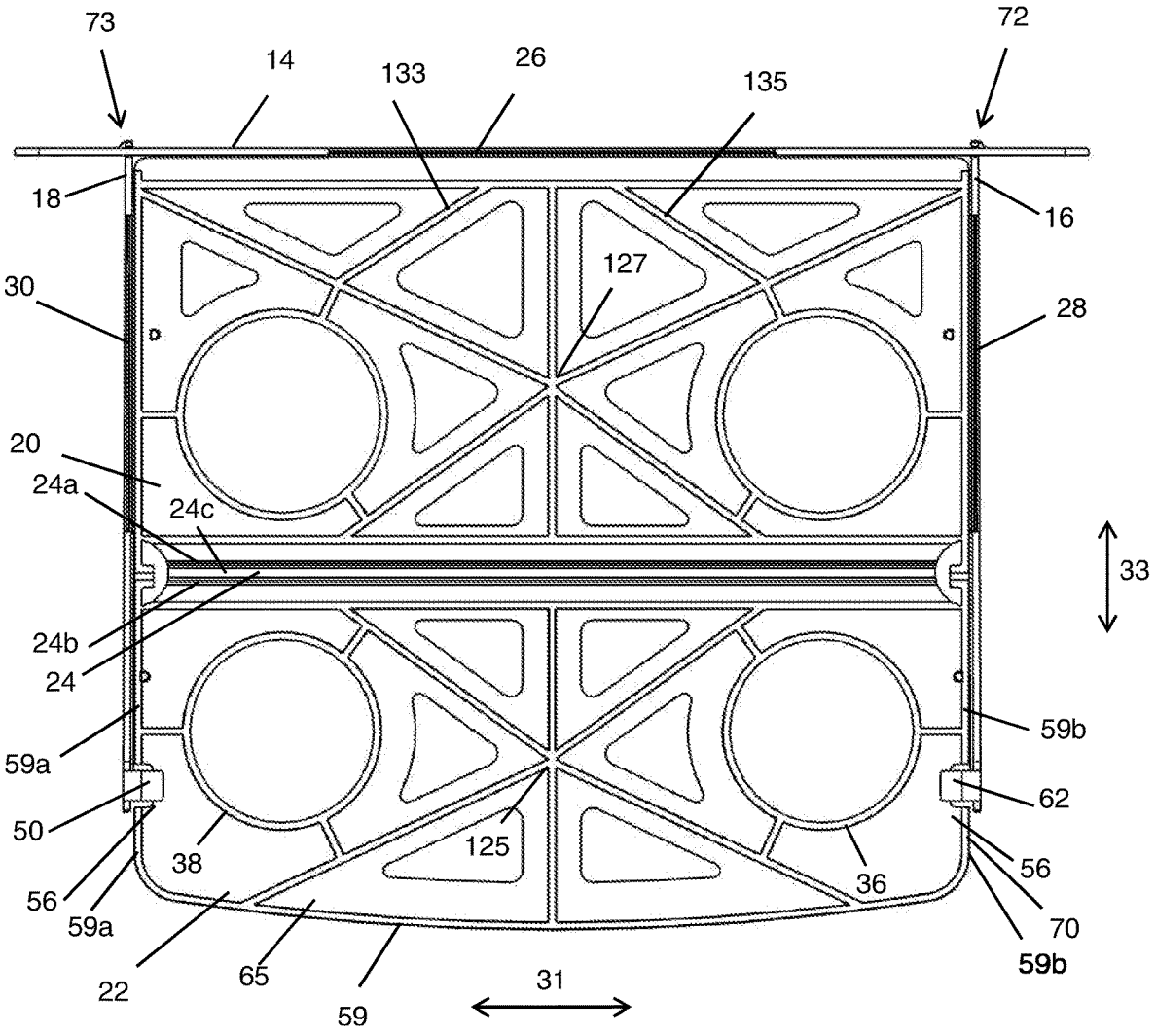
FIG. 3 is a bottom view of the tray of FIG. 1.

The hinge 24 extends along a width 31 of the base 12 and of rear and front portions 20, 22 and between the sidewalls 16, 18, as labeled in FIG. 3. The hinge 24 extends transverse to a length 33 of the rear and front portions 20, 22 as labeled in FIG. 3. The hinge 24 is transverse to the sidewalls 16, 18. In some embodiment, the hinge 24 is parallel to the back wall 14 and a rear hinge 26. In some embodiments, the hinge 24 extends along substantially the entire width of the rear and front portions 20, 22 as shown at least in FIG. 3.

The back wall 14 is connected to the rear portion 20 of the base 12 by the rear hinge 26. The first sidewall 16 is connected to the rear portion 20 of the base 12 by a hinge 28. The second side is connected to the rear portion 20 of the base by a hinge 30. In some embodiments, one or more of all of the hinges 26, 28, and/or 30 is a living hinge or an integral hinge.

Each of hinges 24 and 26 are transverse to each of hinges 26 and 28. Hinge 24 provides an axis of rotation, about the hinge 24, to the front portion that is transverse to the sidewalls 16, 18 and parallel to the back wall 14 and hinge 26. Hinge 26 provides an axis of rotation, about hinge 26, to the base 12 that is transverse to the sidewalls 16, 18 and parallel to the back wall and to the hinge 24. Hinges 26 and 28 provide an axis of rotation for each of the respective sidewalls 16, 18 that is parallel to each other and transverse to the base 12, backwall 14, and hinges 24, 26. In some embodiments, hinges 24 and 26 are parallel, and hinges 26 and 28 are parallel.

In some embodiments, the base comprises a plurality of cup holders comprising cup holder walls 32, 34, 36, 38 defining corresponding cup openings 42, 44, 46, 48. In some embodiments, a bottom wall is provided at the bottom of the cup holder walls to enclose a bottom of the cup holders. In some embodiments, the bottom of the cup holders are open. While 4 cup holders are shown in the drawings, in some embodiments, the base comprises 1, 2, 3, 5, or more cup holders and openings.

The first sidewall 16 extends up from the base on the first side. The first sidewall extends above the base and is transverse to the base when in the deployed configuration. The first sidewall is connected to the base at the hinge 28 and at a support first arm 50 as shown in at least FIGS. 1, 2 and 5. The first arm 50 extends transverse from a front end 52 of a main body 54 of the first sidewall 16. The first arm 50 is configured to extend under a portion of the base and to support and engage a base wall 56 at a recess 58 in the side portion 59*a* of the perimeter wall 59 (FIG. 3) at a first side 60 of the front portion 22 as shown in detail in FIGS. 2, 3 and 5. The arm supports the front portion 22 of the base when the front portion is in the extended position.

Figure 4:
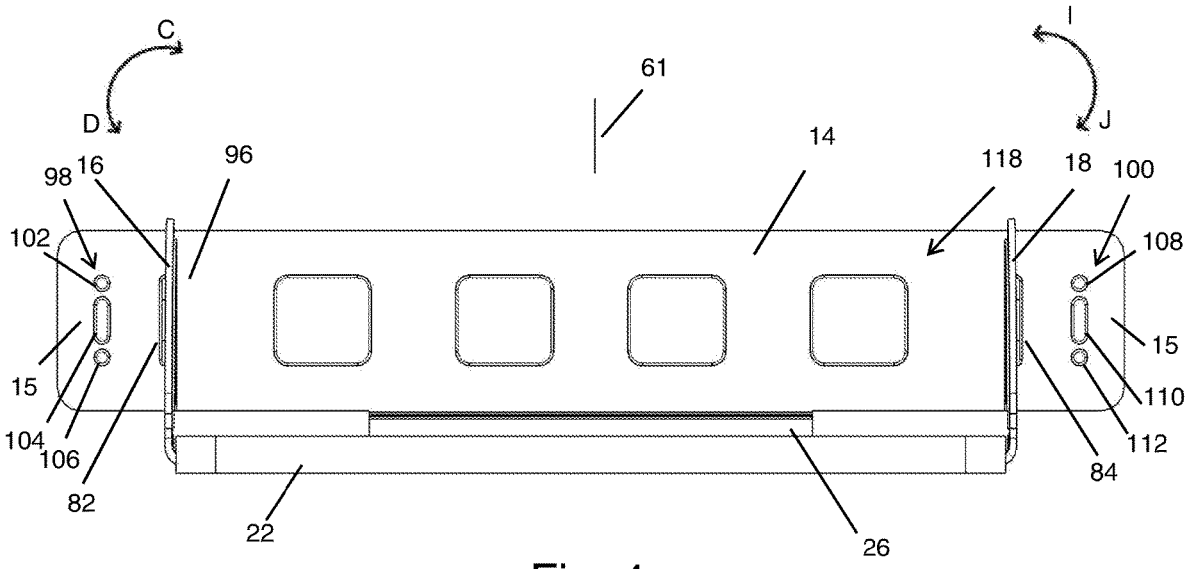
FIG. 4 is a front view of the tray of FIG. 1.

The second sidewall 18 is mirror identical to the first side wall about a mid-plane 61 of the tray 10, shown in FIG. 4, that bi-sects a width of the tray 10. In some embodiment, the base and the tray are symmetric about the mid-plane 61. The second sidewall 18 extends up from the base on the second side and is transverse to the base when in the deployed configuration. The second sidewall is connected to the base at the hinge 30 and at a support second arm 62. The second arm extends transverse from a front end 64 of a main body 66 of the second sidewall 18. The second arm is configured to extend under a portion of the base and to support and engage a base wall 56 at a recess in a side portion 59*b* of the perimeter wall 59 at a second side 70 of the front portion 22 as shown in detail in FIGS. 2, 3 and 5. The second front arm supports the front portion 22 of the base when the front portion is in the extended position.

Figure 5:
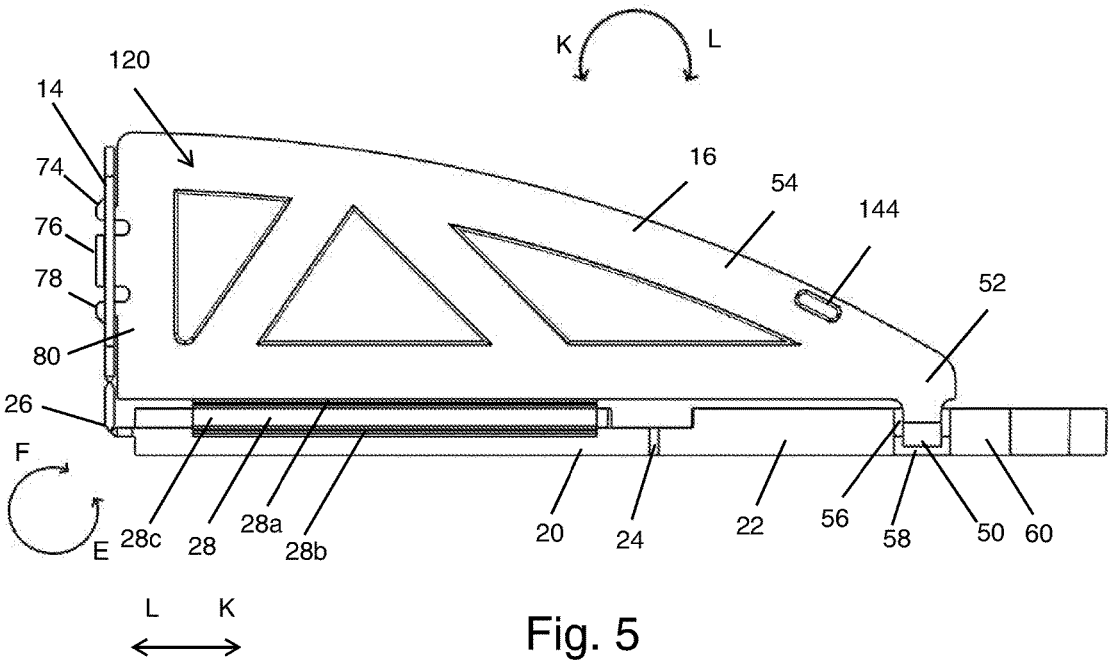
FIG. 5 is a right side view of the tray of FIG. 1.
Figure 6:
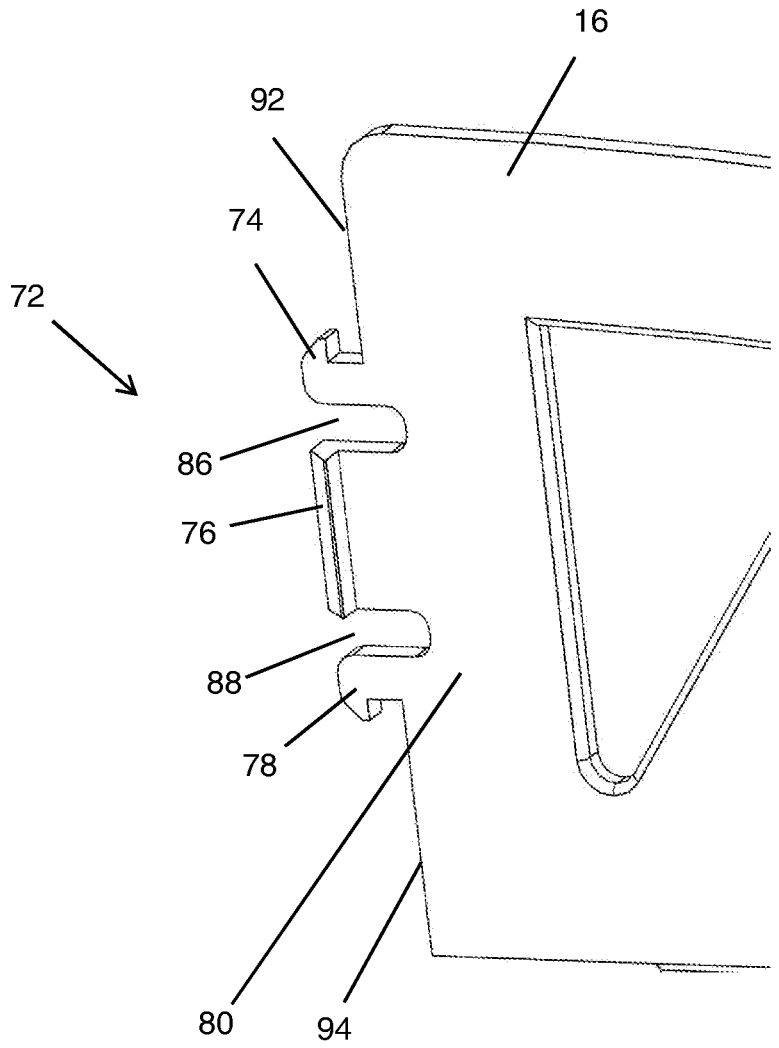
FIG. 6 is a partial side perspective view of a sidewall of the tray of FIG. 1.

Each of the first and second sidewalls 16, 18 comprise a rear clips 72, 73, which engage the back wall 14 at slots 82, 84. As the sidewalls 16, 18 are mirror image identical about the mid-plane 61, clip 72 for the first sidewall 16 will be described in detail. As shown in FIGS. 5 and 6, the clip 72 comprises an upper hook 74, a middle hook 76, and a lower hook 78. The hooks 74, 76, 78 extend from a rear 80 of the sidewall 16. The hook end of upper hook is directed upward as shown in FIG. 6. The hook end of middle hook 76 is directed laterally away from the main body 54 and opposite of the mid-plane 61. The hook end of the lower hook 78 is directed downward as shown in FIG. 6. An upper gap 86 separates the upper hook 74 from the middle hook 76. A lower gap 88 separates the lower hook 78 from the middle hook 76.

Figure 7:
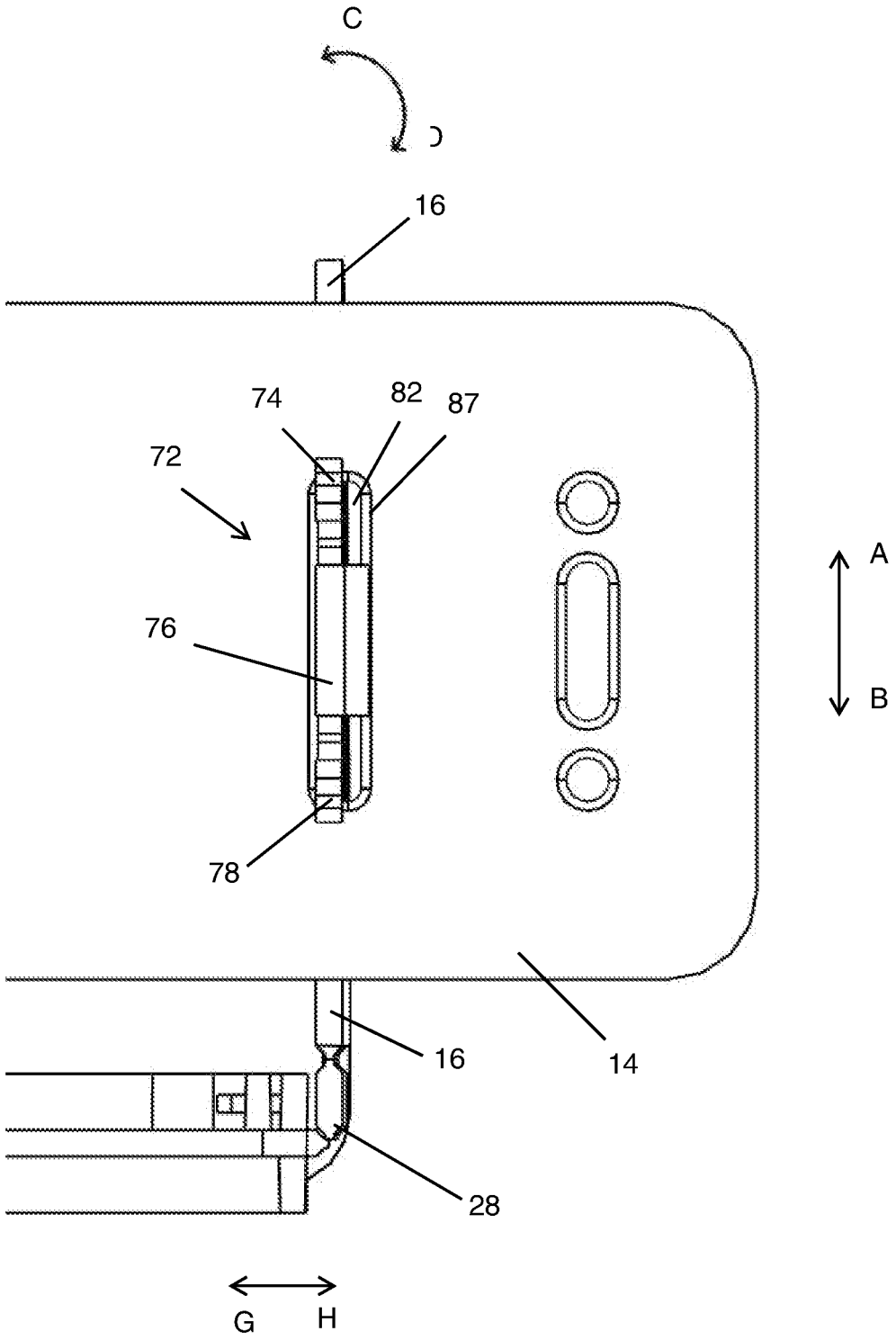
FIG. 7 is a partial rear view of the tray of FIG. 1.

As shown in FIG. 7, the clip 72 engages the back wall 14 at a perimeter 87 of the slot 82. When the clip 72 is engaged with the back wall 14 at the slot, the upper hook 74 overlaps the back wall 14 adjacent a top of the slot, the middle hook overlaps the back wall 14 adjacent an outside lateral portion of the slot, and the lower hook 78 overlaps the back wall 14 adjacent a bottom of the slot.

To release the sidewalls 16, 18 from the back wall 14, for each clip 72, 73, the upper hook 74 is moved down in the direction B of FIG. 7, the lower hook 78 is moved up in the direction A, the middle hook is moved inward in the direction G toward the mid-plane 61. When the hook ends of each respective hook 74, 76, 78 no longer overlap the back wall 14 and are within the slot, the back wall 14 can be and is moved backward in the direction E, of FIG. 5, about the hinge 26, to withdraw the clip 72, 73 from the slot 82, 84, and/or the base 12 and sidewalls 16, 18 can be moved forward and down away from the back wall 14 in the direction F about the hinge 26.

Then the sidewall 16 can and is moved in the direction D about the hinge 28 and initially away from the mid-plane 61. Sidewall 18 can move in direction J about hinge 30 and initially away from the mid-plane 61. Hooks 74, 76 are flexible in up A and down B directions but biased to the position shown in FIG. 7 where the hooks do or will overlap the back wall 14. The gaps 86, 88 provide space for the hooks 74, 76 to flex. Hook 76 is flexible in the side-to-side directions G, H, but biased to the position shown in FIG. 7 where the hooks do or will overlap the back wall 14. The back wall 14 is moveable/pivotable in an arcing path about hinge 26 and/or the base 12 is movable/pivotable in an arching path about hinge 26. As the sidewalls 16, 18 are attached to the base 12, the sidewalls will move with the base in the arching path about hinge 26. Sidewalls 16, 18 are also moveable/pivotable in arcing paths about the respective hinges, 28, 30. In some embodiments, one of the clips 72, 73 can be released from the back and the respective slot before the other of the clips 72, 73 is released. Flexibility in the back wall 14 can allow one clip to be released from the back when the other clip is still engaged with the back.

To engage the sidewalls 16, 18 with the back wall 14, for each clip 72, 73, the clip is aligned with the respective slot 82, 84 by moving in the directions C and/or D about hinge 28 for sidewall 16 and directions I and/or J about hinge 30. Then the back wall is moved forward in the direction F about the hinge 26 and/or the base and sidewalls are moved toward the back in the direction E about the hinge 26, until the clips are seated in the respective slot. The clips are seated when the hooks 74, 76, 78 overlap the perimeter 87 of the slot 82 at the top, side, and bottom, respectively. When the clips 72, 73 are engaged with the slots 82, 84 and the hooks 74, 76, 78 overlap the perimeter, the hooks 74, 76, 78 prevent the back wall 14 from moving away from the sidewall 16, 18 in the direction E about the hinge 26 and the base and sidewalls from moving away from the back wall 14 in the direction F about the hinge 26. Upper and lower back edges 92, 94 of each sidewall 16 (FIG. 6), 18 (not labeled for sidewall 18) engage or are closely adjacent to the front face 96 of the back wall 14 and provide a stop to the forward travel of the back wall 14 in the direction F about the hinge 26 when in the deployed configuration.

When the sidewalls 16, 18 are engaged with the back wall 14 via the clips 72, 73, the side walls support the base 12 via the hinges 28, 30 against further movement about hinge 26.

As shown in FIGS. 1 and 4, the back wall 14 comprises strap apertures on opposite ends of the back. In some embodiments, each lateral end of the back wall 14 comprises a first set of apertures 98 and a second set of apertures 100. The first set of apertures 98 comprises a first, second, and third apertures 102, 104, 106. The first and third apertures 102, 106 can be circular. The second aperture 104 can be vertically elongated. The first, second and third apertures 102, 104, 106 can be vertically aligned as shown in FIG. 4. The second set of apertures 100 comprises a first, second, and third apertures 108, 110, 112. The first and third apertures 108, 112 can be circular. The second aperture 110 can be vertically elongated. The first, second and third apertures 108, 110, 112 can be vertically aligned as shown in FIG. 4.

In some embodiments, as shown in the drawings and labeled in FIG. 2, the base comprises first and second pluralities of triangular or substantially triangular apertures 114, 116. In some embodiments, these apertures comprise other shapes. These apertures may be provided to reduce weight or material required for the base or for other purposes. As labeled in FIG. 4, in some embodiments, the back wall 14 comprises a plurality of square apertures 118, which can be other shapes. These apertures may be provided to reduce weight or material required for the back wall 14 or for other purposes. As shown in FIGS. 1 and 5, in some embodiments, the sidewalls 16, 18, comprise a plurality of triangular or substantially triangular apertures 120, 122. These apertures may be provided to reduce weight or material required for the base or for other purposes. In some embodiments, some or all of the apertures described in this paragraph may be omitted. FIG. 2 shows all of the apertures in the base omitted or alternatively covered with a cover 63, while the cup holders are open. In some embodiments, a cover 63 is placed over the support surface 132, 134 of the rear and/or front portions 20, 22 and the cover covers the apertures of the base described in this paragraph, while leaving open the cup holders. In some embodiments, the cover may cover the hinge 26 but is flexible to allow the hinge to move and to allow the front portion 22 to move at hinge 26 relative to the rear portion 20. In some embodiments, the cover can support articles over the apertures in the front and rear portions under the cover.

As shown in FIG. 3, the base comprises a plurality of structural support members that provide rigidity and support to the base. The front portion 22 comprises six main support members that meet at location 125 and six secondary support members extending from the cup holder walls 36, 38. The rear portion 20 comprises six main support members that meet at a location 127, two additional main support members 133, 135. The rear portion 20 also comprises six secondary support members extending from the cup holder walls 32, 34. In some embodiments, more or fewer support members can be used in the base 12.

Figure 9:
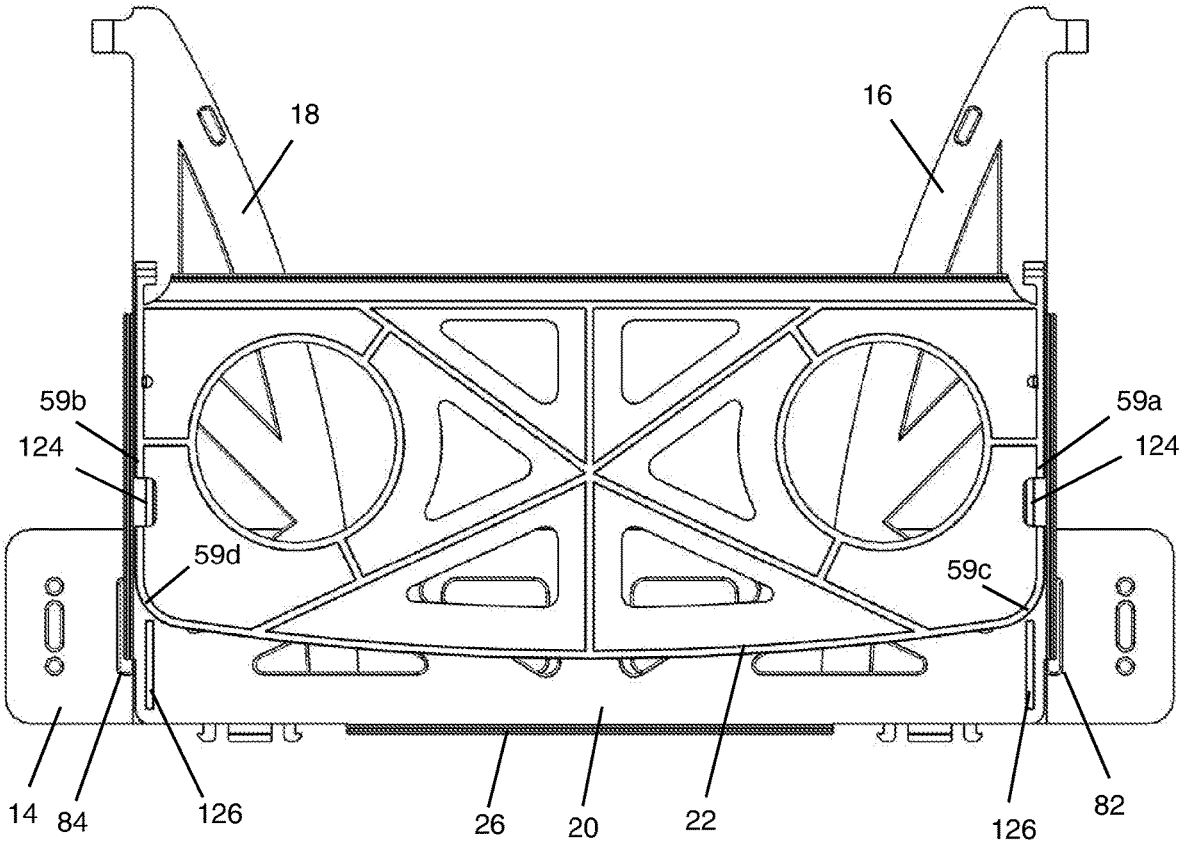
FIG. 9 is a front view of the tray of FIG. 8.
Figure 10:
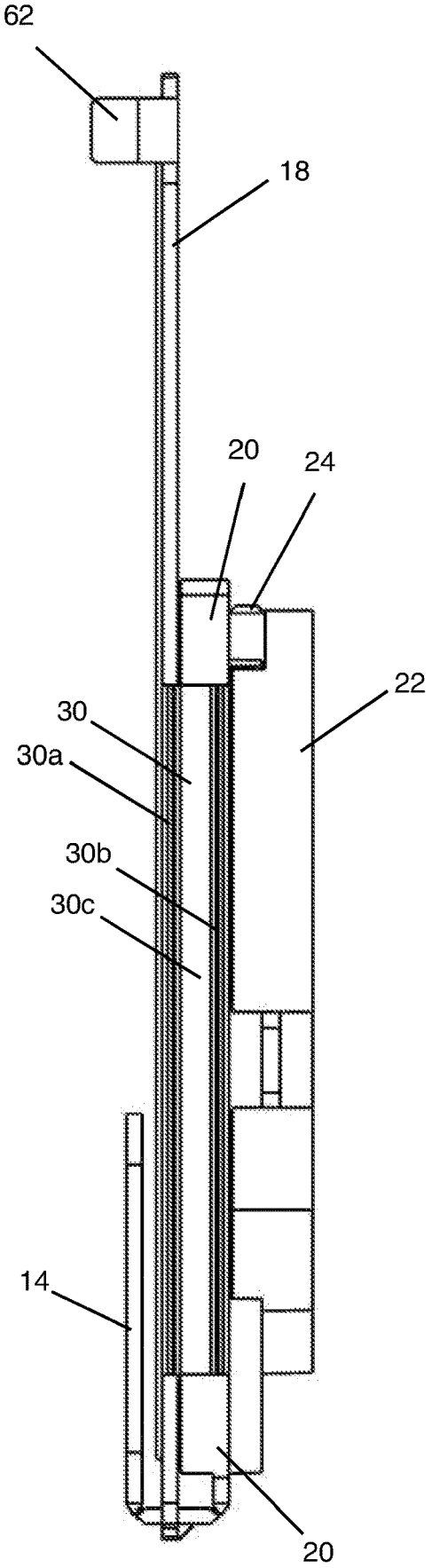
FIG. 10 is a right side view of the tray of FIG. 8.
Figure 11:
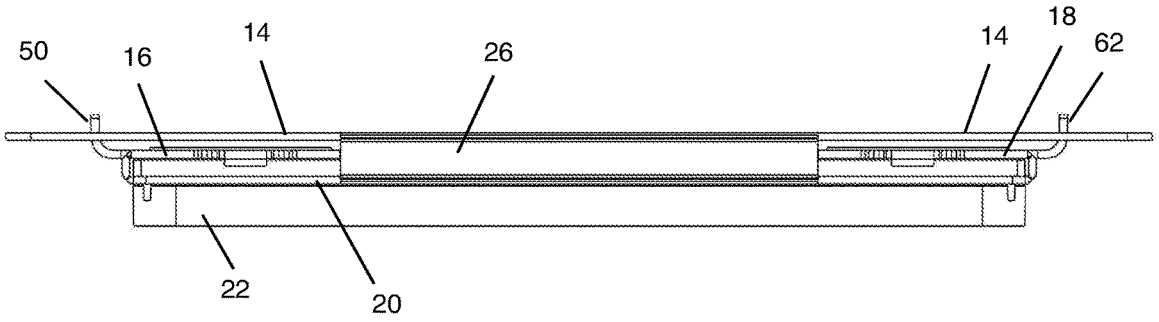
FIG. 11 is a bottom view of the tray of FIG. 8.

The front portion 22 comprises a perimeter wall 59 that bounds the outer edges of the front portion. The rear portion 20 comprises long lips 124 and short lips 126, as labeled in FIGS. 2 and 9. The long and short lips 124, 126 are set inward from the outside lateral edges of the rear portion 20. The inward setting of the long lips 124 provides a receiving space 131 on the rear portion to receive the side portions 59*a*, 59*b* of the perimeter wall 59 of the front portion 22 when the front portion 22 is in the retracted position, as shown in FIG. 9. A gap 129 between the long and short lips 124, 126 allow the front corners 59*c*, 59*d* of the perimeter wall 59 of the front portion 22 to pass between the lips 124, 126 when in the retracted position as shown in FIG. 9.

Figure 2B:
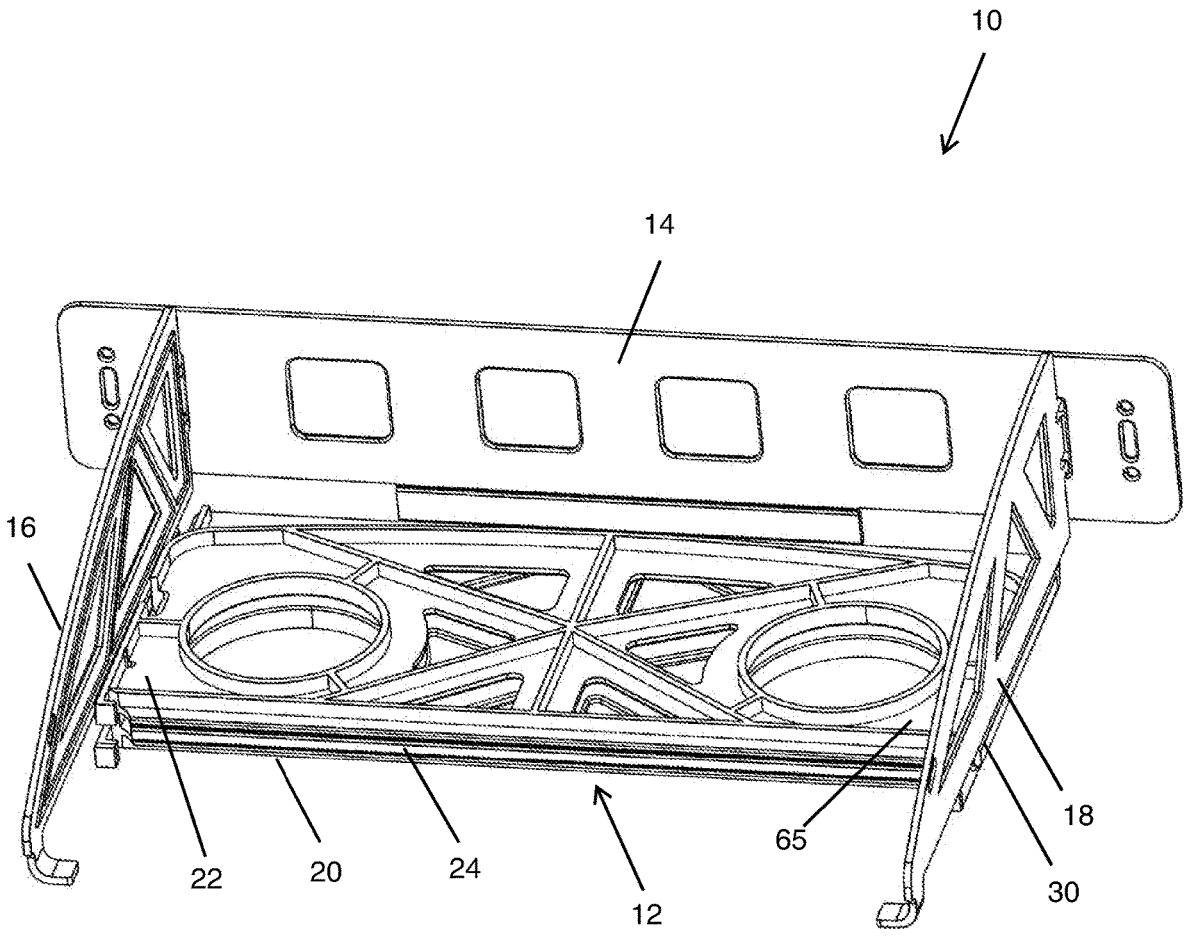
FIG. 2B is a perspective view of the tray of FIG. 1 with a front portion of a base shown in a retracted position.

The front portion 22 is moveable between an extended position shown in FIGS. 1 to 7 and a retracted position shown in FIGS. 2B and 9. The front portion 22 is pivotal about the hinge 24 in the directions K and L, as labeled in FIG. 5. When in the extended position the front portion 22 extends in front of the rear portion 20, and in some embodiments, the front and rear portions are co-planar or substantially co-planar. When in the retracted position, the front portion 22 overlaps the rear portion 20 as shown in FIGS. 2B and 9. The front portion 22 can be moved to the retracted position even when all the remaining portions of the tray remain in the deployed configuration, such as shown in FIG. 2B. When in the retracted position, the upper tray or support surface 132 (FIG. 1) of the front portion 22 faces an upper tray or support surface 134 of the of the rear portion 20. The bottom 65 of the front portion faces up when the front portion is in the retracted position. Articles can be supported on the bottom 65 of the front portion when in the retracted position. In some embodiments, the bottom of the front portion has a flat surface for supporting articles outside of the cup holders and the support members, such as at 125, are covered or not used. Therefore, the bottom 65 of the front portion can support articles when in the retracted position. The user may move the front portion 22 between the extended and retracted positions depending the extent of tray surface needed at a given time and/or the available surrounding space needed for operating the tray in the extended position. A user may use the cup holders when the front portion is in the retracted position. In some embodiments, each of cup holders of the front portion axially aligned with one of the cup holders of the rear portion has shown in FIGS. 2B and 8.

The perimeter wall 59 can extend above the upper tray or support surface 132 of the front portion so that the perimeter wall forms a boundary at the perimeter edges of the top surface, as shown in FIG. 1. The lips 124, 126 of the base extend above the upper tray of support surface 134 of the rear portion.

The base of the tray is usable and wearable at least in the extended position shown in FIG. 1 and in a retracted position shown in FIG. 2B. And the user can move the tray from the extended to the retracted position by pivoting the front portion about the hinge 24 in the direction K (FIG. 5) until the front portion overlaps and is laying on the rear portion, as shown in FIG. 2B. The tray can be moved back to the extended position by pivoting the front portion about the hinge 24 in the direction L (FIG. 5) until the front portion is co-planar or level with the rear portion and extends in front of the rear portion as shown in FIGS. 1, 4, and 5.

To move the tray 10 from the deployed configuration shown in FIGS. 1 to 7 to the compact configuration shown in FIGS. 8 to 11, the front portion is moved from the deployed position to the retracted position by pivoting the front portion about the hinge 24 in the direction K (FIG. 5) until the front portion overlaps and is laying on the rear portion as shown in FIG. 2B. Then the clips 72, 73 are removed from the slots 82, 84, as described above to release the sidewalls 16, 18 from the back wall 14. Then the sidewall 16, 18 are pivoted about hinges 28, 30 in directions J, D respectively until the sidewalls 16, 18 are under the base 12. Then the back wall 14 is pivoted about hinge 26 in the direction E until the back wall 14 is under the base 12 and the sidewalls 16, 18, and/or the base 12 can be pivoted in the direction F about the hinge 26 until the back wall 14 is under the base.

To move the tray from the compact configuration to the deployed configuration, the back wall 14 is pivoted about hinge 26 in the direction F at least until the back wall does not overlap the sidewalls 16, 18. The sidewalls 16, 18 are pivoted upward about respective hinges 28, 30 in the directions C, I, respectively. The sidewall 16, 18 are moved in the directions C, I, respectively until the clips 72, 73 are aligned with the respective slots 82, 84 in the back wall 14. The back wall 14 may be moved in the direction F during the aligning of the clips and slots. When the clips and slots are aligned, the back wall 14 is moved toward the clips about the hinge 26 in the direction F and/or the base and the sidewalls are moved toward the back wall 14 about the hinge in the direction E until the clips are engaged with the back in the slots and the hooks of the clips overlap the back wall 14 adjacent the slots.

In some embodiments, the front portion comprises a length from the hinge 24 forward that is less than a length of the rear portion from the hinge 26 to hinge 24. The sidewalls 16, 18 comprises a substantially triangular shape with a curved upper edge as shown in FIG. 5. However, the sidewalls may comprise other shapes.

Figure 12:
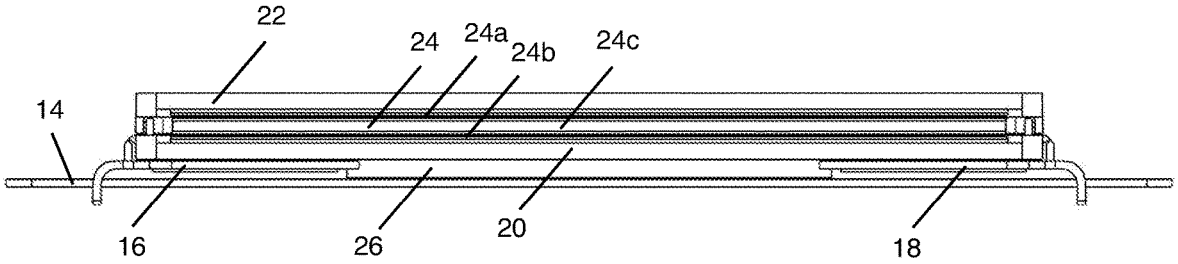
FIG. 12 is a top view of the tray of FIG. 8.

In some embodiments, one or more or all of the hinges 24, 26, 28, and 30 comprise two joints 24*a*, 24*b* (FIGS. 3 and 12), 26*a*, 26*b* (FIG. 1), 28*a*, 28*b* (FIG. 5), 30*a*, 30*b* (FIG. 10), respectively. When the hinges 24, 26, 28, 30 comprise two joints, they comprise a bridging member 24*c*, 26*c*, 28*c*, and 30*c* between opposite joints, respectively. Joint 24*a* allows bridging member 24*c* to move relative to the rear portion 20. Joint 24*b* allows the front portion 22 to move relative to the bridging member 24*c*. Joint 26*a* allows the back wall 14 to move relative to the bridging member 26*c*. Joint 26*b* allows the base 12 to move relative to the bridging member 26*c*. Joint 28*a* allows the first sidewall 16 to move relative to the bridging member 28*c*. Joint 28*b* allows the bridging member 28*c* to move relative to the rear portion 20. Joint 30*a* allows the second sidewall 18 to move relative to the bridging member 30*c*. Joint 30*b* allows the bridging member 30*c* to move relative to the rear portion 20.

Figure 8:
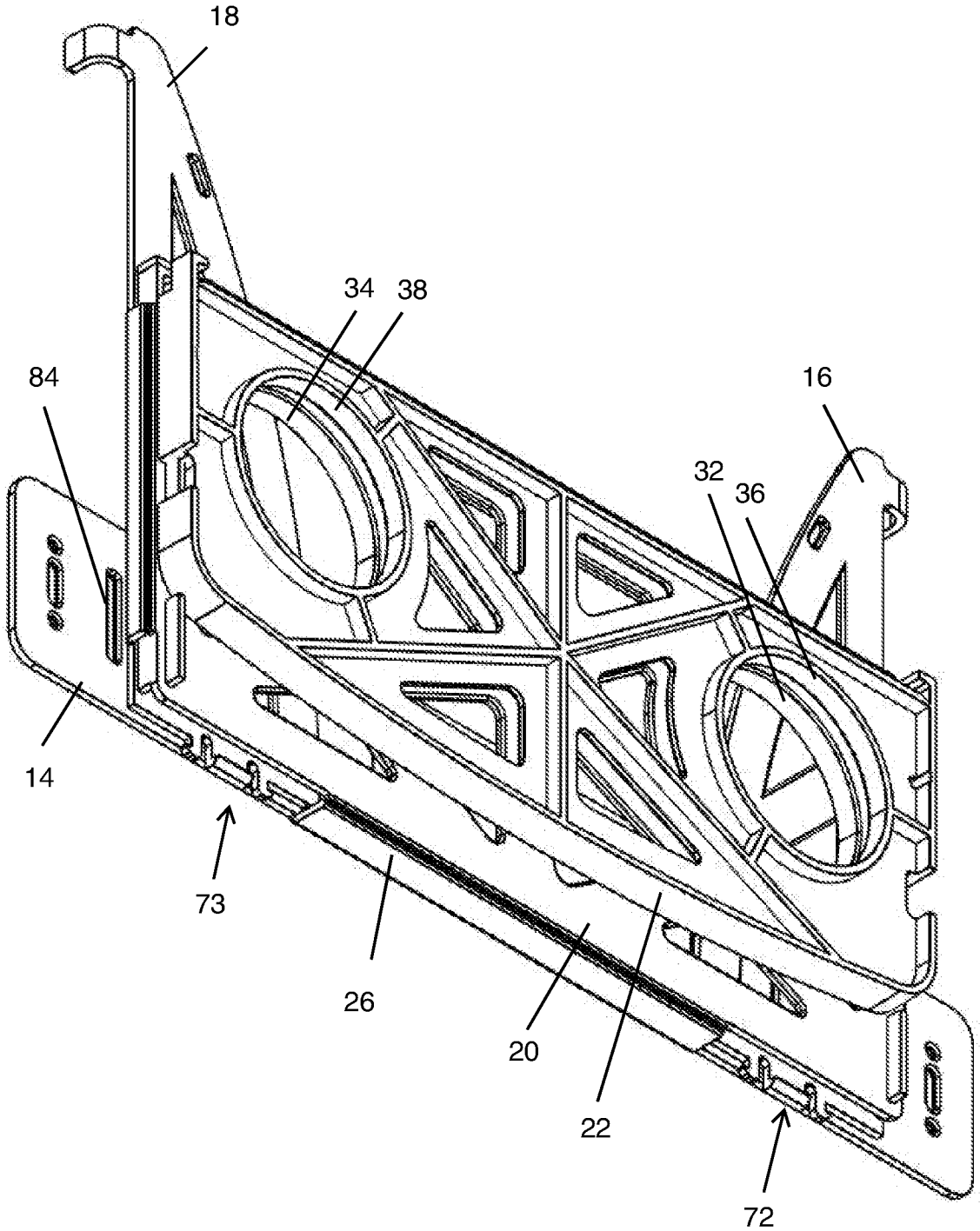
FIG. 8 is a rear perspective view of the tray of FIG. 1 in a compact configuration.

When the hinge(s) 24, 26, 28, and 30 comprise two joints, the joints and bridging member allow a greater range of motion to one or more of the elements connected by the respective hinge. For example, where FIG. 5 shows the first sidewall positioned slightly above the base, the hinge 28 allows the sidewall to be stowed under the base as shown in FIG. 8. The second sidewall has a similar range of motion and positioning. Further, the hinge 26, when in the compact configuration of FIG. 8 allows space between the back wall 14 and the rear portion 20 of the base sufficient for the sidewalls 16, 18 to be located between the back wall 14 and rear portion 20. Moreover, hinge 24 allows sufficient space between the front portion 22 and the rear portion 20 when the front portion 22 is in the retracted position to accommodate the height of the perimeter wall 59 and lips 124, as shown in FIGS. 8 to 12. In some embodiments, the joints act as a living hinge or an integral hinge where the joint may comprise a thinned, scored, or cut to allow joined portions to bend along the line of the joint.

Figure 13:
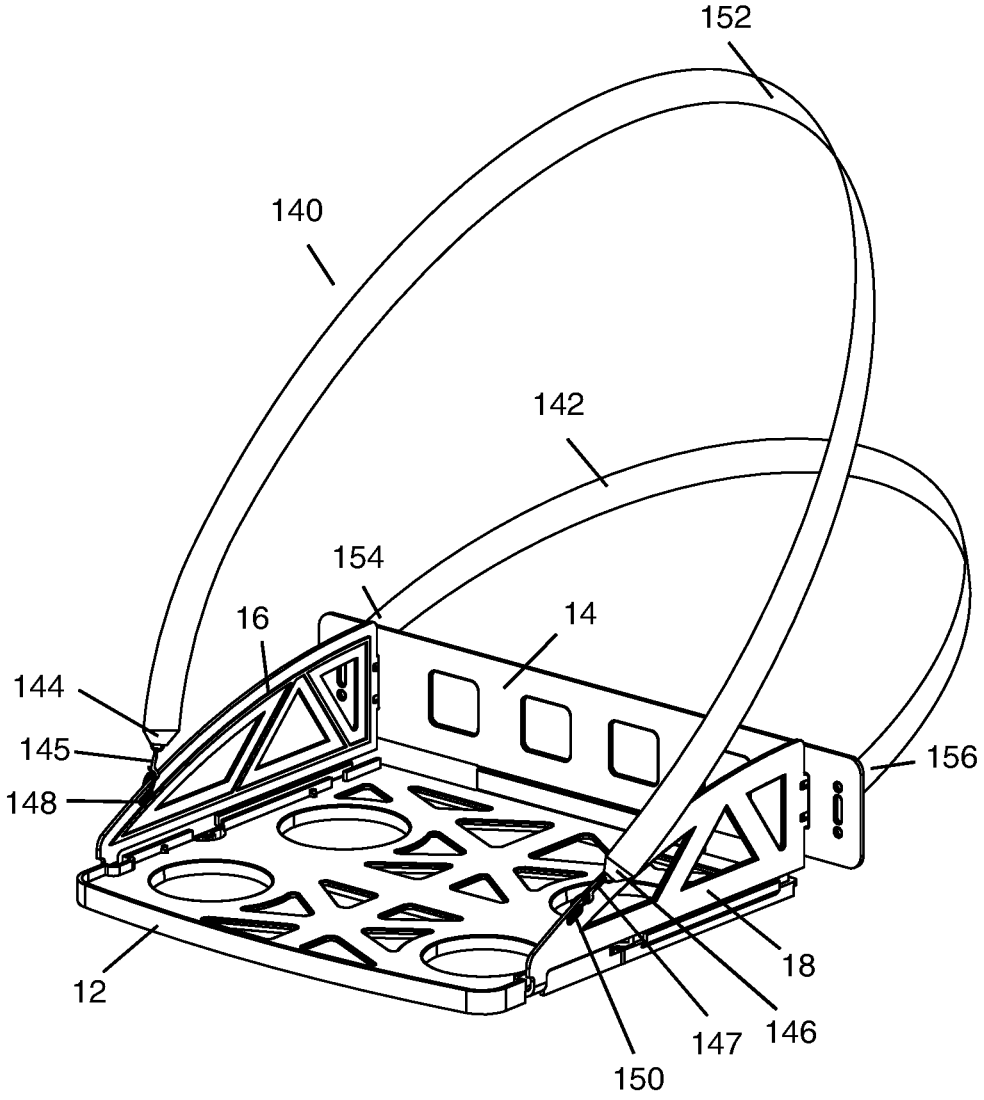
FIG. 13 is a perspective view of the tray of FIG. 1 shown with straps.
Figure 14:
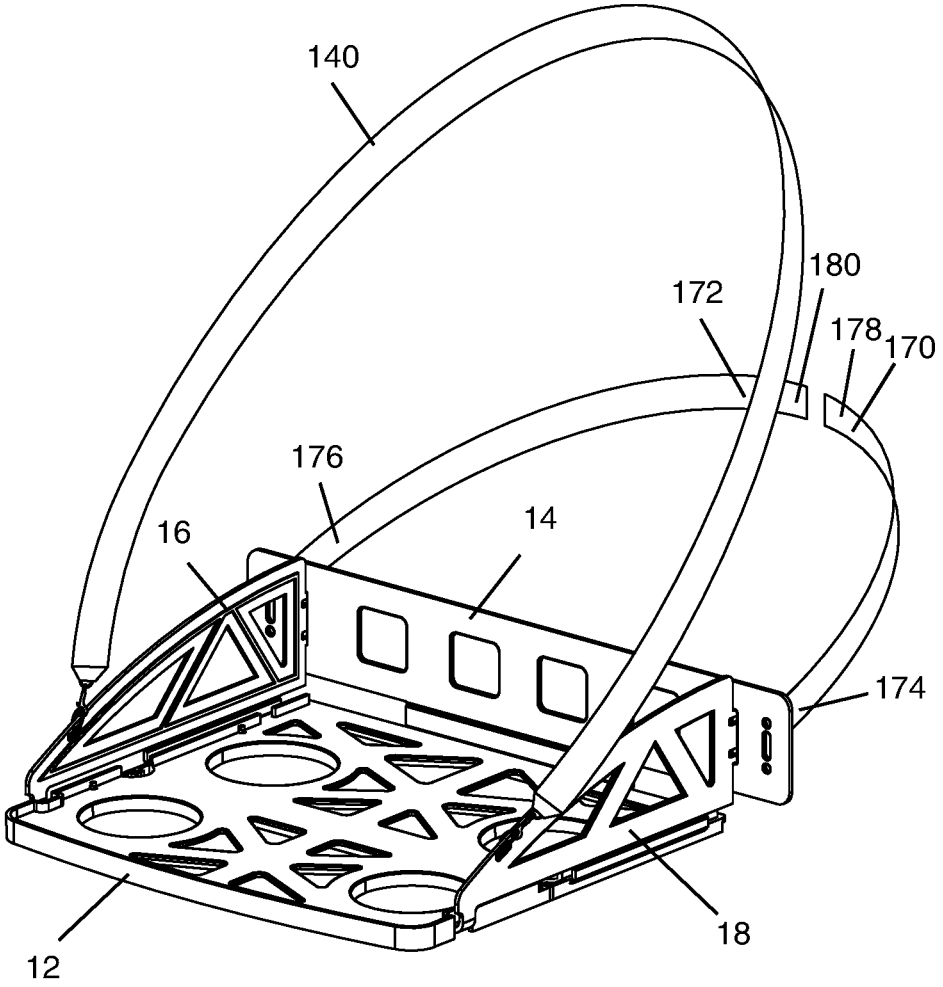
FIG. 14 is a perspective view of the tray of FIG. 13 shown with alternative waist straps.
Figure 15:
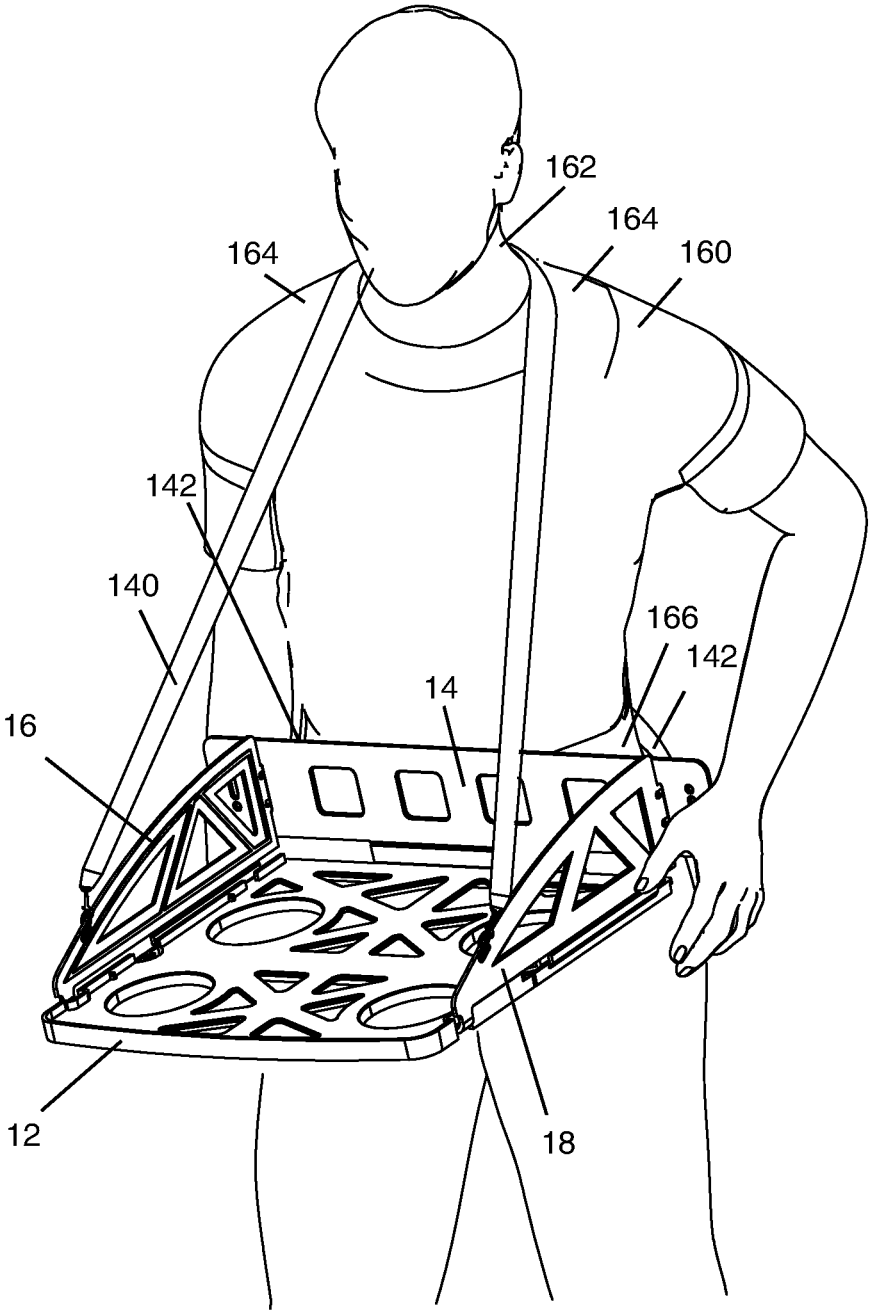
FIG. 15 is a perspective view of the tray of FIG. 13 shown worn by a person.

The tray 10 comprises or is useable with one or more straps 140, 142, as shown in FIGS. 13 to 15 for supporting the tray on the body of a person. The neck strap 140 is configured to connect at opposite ends 144, 146 of the strap, to the sidewalls 16, 18 at neck strap apertures 148, 150. The neck strap apertures are at a front end of each sidewall 16, 18. The neck strap 140 can be worn around the back of a wearer's 160 neck 162*a* shown in FIG. 15. The neck strap extends around the back of the wearer's neck and over the front of the wear's shoulders 164 toward the sidewalls 16, 18 of the tray. A midpoint 152 between the ends 144, 146 may be located at the back of the wearer's neck when the strap is worn. In some embodiments, the ends 144, 146 each comprise a hook or clip 145, 147 that engages or releasably engages the respective sidewall at the respective aperture 148, 150 to join the strap to each sidewall. In some embodiments, the ends 144, 146 extend through the respective aperture 148, 150 and are joined back to the strap to form a loop extending through the aperture 148, 150 and thereby securing the strap to the sidewalls.

The waist strap 142 extends from opposite ends 154, 156 from the back wall 14. In some embodiments, the strap is placed around the waist 166 of a wearer 160 and connected to the back wall 14. In some embodiments, two waist straps 172, 170 are used, each strap is connected at one end 174, 176 to the back plate. The straps 170, 172 are joinable at ends 178, 180. In some embodiments, a D-ring (not shown) is used to releasably joint the ends 178, 180. Other buckles, clips, or hooks to releasably join the ends 178, 180 of the strap can be used. In some embodiments, one strap 170, 172 is shorter and the other of the straps 170, 172 is longer so that the ends of each strap may be configured to join at a preferred location about the wearer, such as at the wearer's side.

Figure 16:
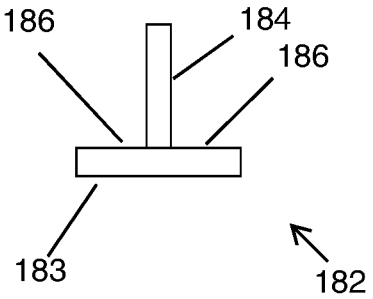
FIG. 16 is a top view of a first embodiment anchor of the tray of FIG. 1.
Figure 17:
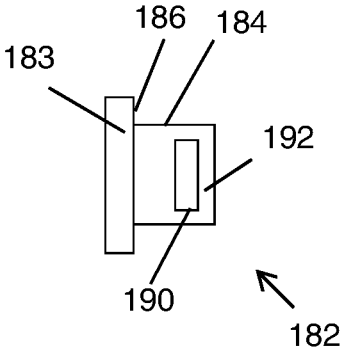
FIG. 17 is a side view of the anchor of FIG. 16.
Figure 18:
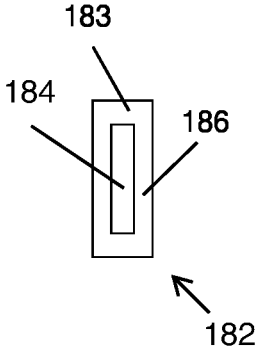
FIG. 18 is an end view of the anchor of FIG. 16.

FIGS. 16 to 18 shows a first embodiment strap anchor 182. Two of the anchors 192 can be used to connect the strap ends 154, 156 of strap 142 or the strap ends 174, 176 of straps 170, 172 to the back wall 14. The anchor 182 has a base plate 183 and an arm 184 extending from the base plate. The arm comprises strap aperture 190. One of the strap ends 154, 156, 174, 176 extend through the respective aperture 190 and is joined back to the strap to form a loop extending through the aperture 190 and around the end bar 192 and thereby securing the strap to the strap anchor. Before the strap is connected to the anchor, the arm 184 of the anchor is placed into one of the apertures 104, 110 until the inside face 186 of the base wall 14 of the anchor contacts or is in close proximity to a front face 15 (FIG. 4) of the back wall 14. Then the arm extends beyond the back wall 14 on a side of the back plate opposite the front face 15. The strap can then be attached at the strap aperture 190, such as described. Therefore, two anchors 182 can be used, one at each of the apertures 104, 110, to join the ends of the strap 142 or straps 170, 172 to the back plate and around the waist of a wearer.

Figure 19:
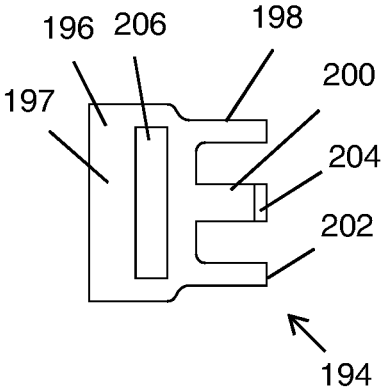
FIG. 19 is a side view of a second embodiment anchor of the tray of FIG. 1.
Figure 20:
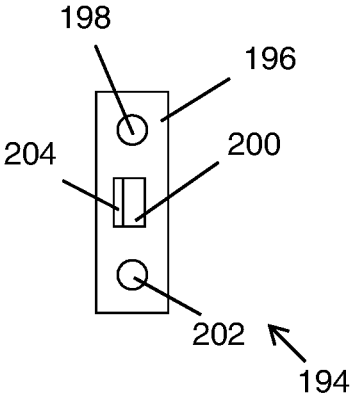
FIG. 20 is an end view of the anchor of FIG. 19.
Figure 21:
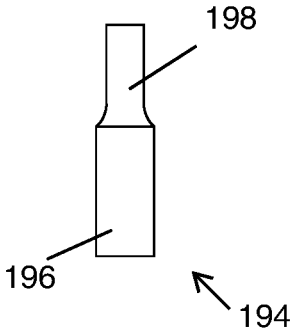
FIG. 21 is a top view of the anchor of FIG. 19.

FIGS. 19 to 21 show a second embodiment strap anchor 194. The anchor 194 comprises a rear portion 196 comprising a strap aperture 206. The anchor 194 extending from the rear portion 196. In some embodiments, the upper and lower prong 198, 202 are cylindrical. The middle prong 200 comprises a hook 204 at the terminal end. The anchor(s) can be used to connect the ends 154, 156 of the strap 142 or ends 174, 176 of strap 170, 172 to the back wall 14. The strap extends through the aperture 206 an connects back to itself to form a loop around a back bar 197. The looped strap end connects the strap to the anchor. To connect the anchor to the back plate, the upper and lower prongs 198, 202 are aligned with the upper and lower apertures 98, 106 in the case of the first set of apertures 98 or upper and lower apertures 108, 112 in the case of the second set of apertures 100. The middle prong is aligned with aperture 104 or 110 of the respective set of apertures 98, 100.

When the prongs are aligned with the respective apertures of the back wall 14, the anchor 194 is moved from the back side of the back plate forward, in the direction K of FIG. 5, toward the apertures. The upper and lower prongs are received in the upper and lower apertures 102, 106 or 108, 112, and the middle prong is received into the second aperture 104 or 110. When the hook 204 goes through the aperture 104, 110 and passes the back wall 14, the hook is biased inward toward the mid-plane 61 or depending on the orientation of the anchor, outward away from the mid-plane 61. Therefore, if the anchor is drawn back, in the direction L of FIG. 5, to exit the aperture 104, 110 the hook will engage a corresponding portion of the back wall 14 at the perimeter of the aperture 104, 110 to prevent the withdraw of the anchor from the aperture 104, 110. The anchor can be withdrawn if a user overcomes the bias of the hook and moves the hook so that the hook does not overlap at the perimeter of the aperture and is instead within the aperture, and the anchor is drawn rearward in the direction L of FIG. 5. Therefore, second embodiment strap anchor 194 can clip into the back plate via the hook 204 of the anchor. The waist strap 142, 170, 172 can be connected via the anchors 182, 194 before or after the back plate is placed against a user's torso at the abdomen, waist, or hip area.

The neck strap 140 when connected to the side walls 16, 18 supports the tray 10 via the user's neck and biases the tray rearward. The waist strap 142, 170, 172 further secures the tray to the user at or about the user's abdomen, waist, hips. The waist belt prevents excessive lateral movement of the tray relative to the user, depending on how loose or tight the belt is about the user. The waist belt also provides vertical support to the back of the tray opposite of where the neck strap attaches to the sidewalls.

Figure 22:
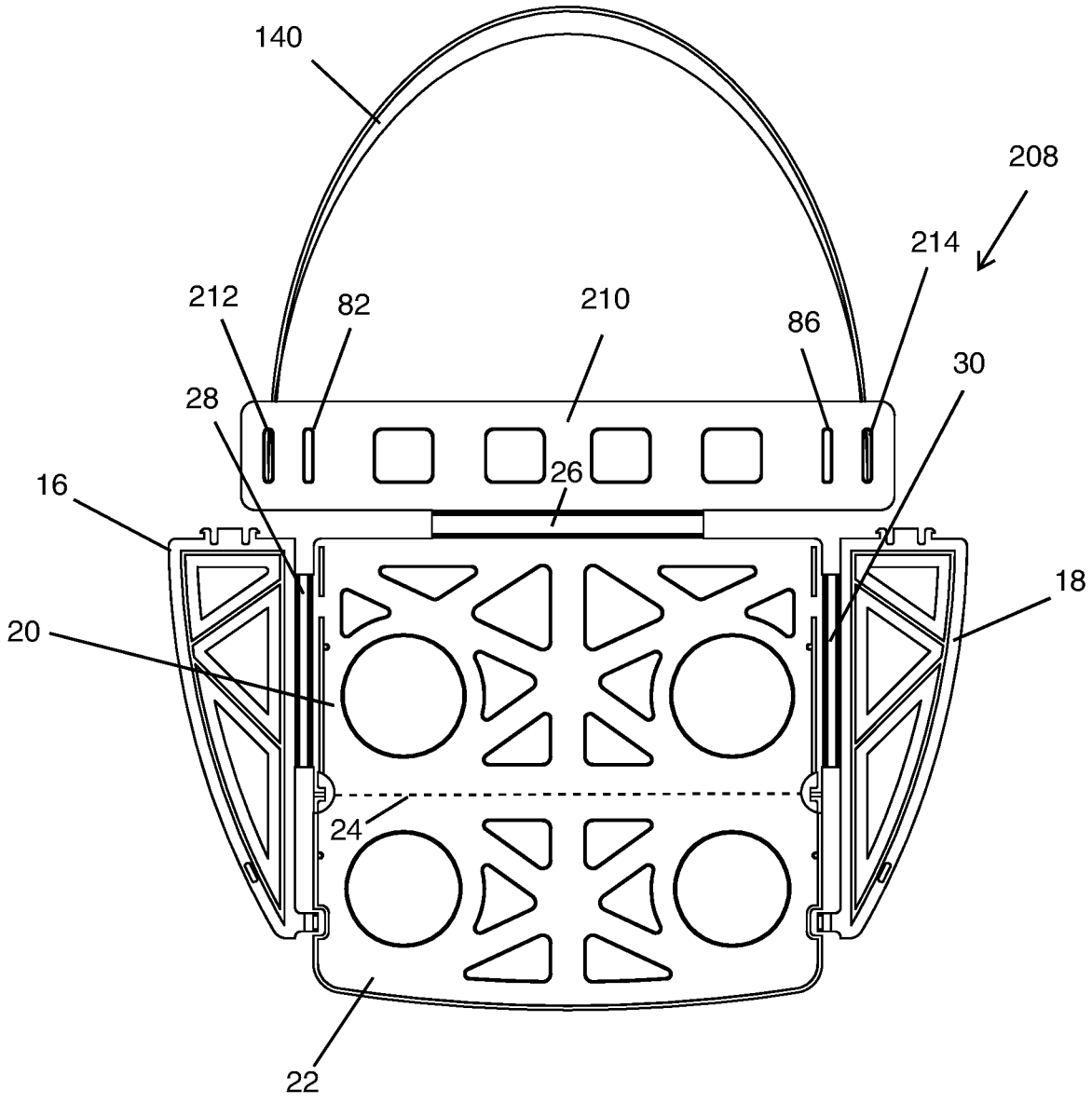
FIG. 22 is a top perspective view of a second embodiment tray of the invention shown in a released configuration.

FIG. 22 shows a second embodiment wearable tray 208, which is the same as tray 10, except that tray 208 has a different back wall 210. The tray 208 is used and operates the same way as tray 10 operates, including in and between the extended position, the retracted position, and the compact configuration. The back wall 210 is the same as back wall 14 except that a first aperture 212 is used in place of the first set of apertures 98 and a second aperture 214 is used in place of the second set of apertures 100. The first and second apertures 212, 214 are elongated slots that can receive waist strap 142 or 170, 172 or strap anchors 182, 194 attached thereto. When anchors 194 are used, prongs 198 may engage a top of the respective aperture 212, 214 and the back wall 14 at the perimeter thereof, prong 200 and its hook 204 may engage a middle of the aperture 212, 214 and the back wall 14 at the perimeter thereof, and prong 202 may engage the bottom of the aperture 212, 214 and the back wall 14 at the perimeter thereof.

Figure 23:
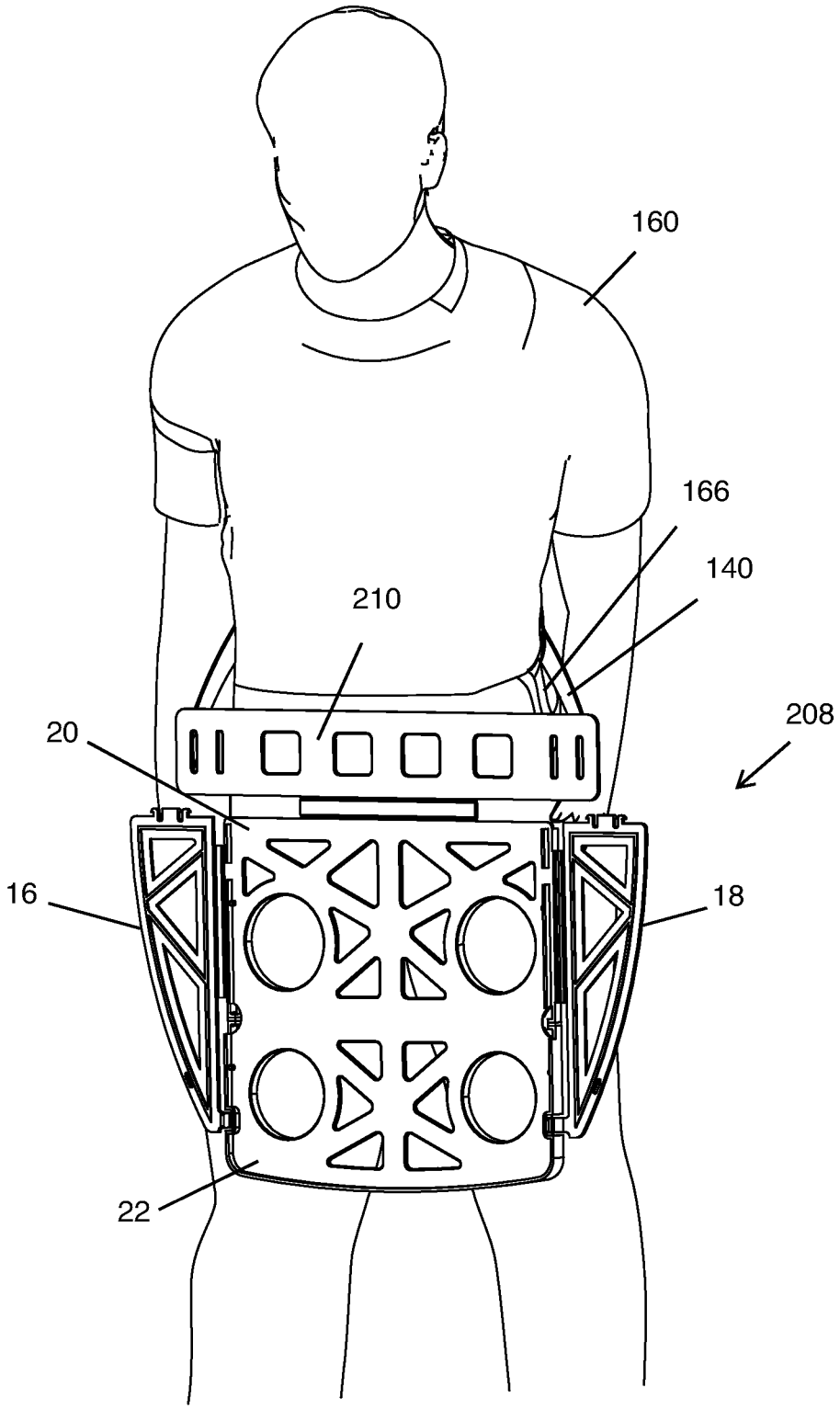
FIG. 23 is a perspective front view of the tray of FIG. 22 worn by a person.

The trays 10, 208 can be moved from the deployed configuration (including from the extended or retracted position) of FIGS. 1 or FIG. 2B to the released configuration of FIG. 22. The clips 72, 73 are removed from the slots 82, 84, as described above to release the sidewalls 16, 18 from the back wall 14, 210. Then the rear and front portions 20, 22 of the base 12 will pivot downward in the direction F about hinge 26, by the user assistance and/or by gravity. The base may pivot about hinge 26 until it is aligned, or co-planar, or substantially co-planar with the back wall 14, 210. In some applications, the base may be allowed to freely move via hinge 26 relative to the back wall 14, 210, with gravity of other forces applied determining its position. The sidewalls 16, 18 can optionally, pivot in the directions D, J respectively, about hinges 28, 30, respectively, to be aligned, or co-planar, or substantially co-planar with the rear portion 20 and/or the front portion 22 of the base 12. In some applications, the sidewalls 16, 18 may be allowed to freely move via hinge 28, 30 relative to the base 12, with gravity of other forces applied determining its position. In the released configuration, the tray 10, 208 can be worn around the user's waist via the waist strap 142 or 170, 172 and the base will extend vertically below the back wall 14, 210, such as shown in FIG. 23. Further, the tray 10, 208 can be rotated about the waist of the user so it extends down from a user's back or backside (not shown). In some applications, on or both side walls 16, 18 can be further pivoted about the respective hinge 28, 30, in the directions D and J, respectively, from the aligned position shown in FIG. 22, until the sidewalls 16, 18 are behind or under the base.

To move the trays 10, 208 from the released configuration of FIG. 22 to the deployed configurations of FIG. 1 or FIG. 2B, the base 12 is raised about hinge 26 in the direction E. The side walls 16, 18 are pivoted about the hinges 28, 30, respectively, as needed until and to align each clip 72, 73 with the respective slot 82, 84. Then the base is further raised in the direction E causing the clips to engage the slots 82, 84, and once engaged, to secure the tray in the deployed configuration of FIG. 1 or 2B.

From the foregoing, it will be observed that numerous variations and modifications may be affected without departing from the spirit and scope of the invention. It is to be understood that no limitation with respect to the specific apparatus illustrated herein is intended or should be inferred. For example, one or more component embodiments may be combined, modified, removed, or supplemented to form further embodiments within the scope of the invention. Further, steps could be added or removed from the processes described. Therefore, other embodiments and implementations are within the scope of the invention.

The invention claimed is:

1. A wearable tray, comprising:

a base comprising a hinge, a tray front portion, and a tray rear portion, the hinge connecting the front portion to the rear portion, and the front portion is moveable about an axis of rotation at the hinge between an extended position and a retracted position where the axis of rotation extends along a width of the base;

a back wall connected to the base;

a first sidewall connected to the base;

a second sidewall connected to the base opposite the first sidewall, the front portion is between the first sidewall and the second sidewall when in the extended position, the front portion is supported by the first sidewall and the second sidewall when in the extended position, extends a forward length of the base when in the extended position, and is disengaged from the first sidewall and the second sidewall when in the retracted position; and, a neck strap connected to the first sidewall and the second sidewall.

2. The tray of claim 1, wherein the axis of rotation is transverse to a length of the rear portion that extends between the back wall and a front of the rear portion.

3. The tray of claim 1, comprising a first side hinge and a second side hinge, the first side hinge connecting the first sidewall to the base, the second side hinge connecting the second sidewall to the base, the first sidewall is movable about the first side hinge between a raised position where the first sidewall extends above the base and a compact position where the first sidewall is under the base, the second sidewall is movable about the second side hinge between a raised position where the second sidewall extends above the base and a compact position where the second sidewall is under the base.

4. The tray of claim 1, comprising a second hinge connecting the back wall to the base, the base is movable about the second hinge.

5. The tray of claim 4, wherein the second hinge is an integral hinge.

6. The tray of claim 4, wherein the back wall movable about the second hinge between a raised position where the back wall extends transversely from the base and a compact position where the back wall is under the base.

7. The tray of claim 1, wherein the first sidewall comprises a first clip configured to releasably engage the back wall and to secure the first sidewall to the back wall, and the second sidewall comprises a second clip configured to releasably engage the back wall and to secure the second sidewall to the back wall.

8. The tray of claim 7, wherein each of the first clip and the second clip comprise an upper hook, a middle hook, and a lower hook.

9. The tray of claim 7, wherein the back wall comprises a first aperture and a second aperture, the first aperture receives the first clip and the second aperture receives the second clip.

10. The tray of claim 1, wherein the base comprises a cup holder.

11. The tray of claim 1, wherein the front portion comprises a first plurality of cup holders and the rear portion comprises a second plurality of cup holders, and when the front portion is in the retracted position each of the first plurality of cup holders is axially aligned with a corresponding cup holder of the second plurality of cup holders.

12. The tray of claim 1, wherein each of the first sidewall and the second sidewall comprise a support arm extending transverse from a main portion of the sidewall at a front end and configured to support a bottom of the front portion in the extended position.

13. The tray of claim 1, wherein the front portion comprises a perimeter wall.

14. The tray of claim 1, wherein the rear portion comprises a plurality of side lips.

15. The tray of claim 1, wherein the front portion is co-planar with the rear portion when in the extended position.

16. A human body supported tray, comprising:

a base comprising a hinge, an article support surface, a front portion, and a rear portion, the hinge connecting the front portion to the rear portion, the front portion is pivotal about an axis of rotation at the hinge between an extended position and a retracted position where the axis of rotation extends along a width of the base, the front portion and the rear portion each comprise a portion of the article support surface;

a back wall connected to the base;

a first sidewall connected to the base;

a second sidewall connected to the base opposite the first sidewall, the front portion is between the first sidewall and the second sidewall when in the extended position, the front portion is supported by the first sidewall and the second sidewall when in the extended position, extends a forward length of the article support surface when in the extended position, and is disengaged from the first sidewall and the second sidewall when in the retracted position; and, a neck strap connected to the first sidewall and the second sidewall.

17. A method of deploying a human wearable tray, comprising the steps of:

pivoting a base about a first hinge connected to a back wall;

pivoting a first sidewall about a second hinge connected to the base;

pivoting a second sidewall about a third hinge connected to the base;

connecting the first sidewall to the back wall by engaging a first clip of the first sidewall to the back wall at a first aperture of the back wall;

connecting the second sidewall to the back wall by engaging a second clip of the second sidewall to the back wall at a second aperture of the back wall; and, pivoting a tray front portion of the base about an axis of rotation at a fourth hinge connected to a front portion of the base from a retracted position where the front portion is disengaged from the first sidewall and the second sidewall to an extended position where the front portion is supported by the first sidewall and the second sidewall and extends a forward length of the base, the axis of rotation extends along a width of the base.

18. The method of claim 17, wherein the step of pivoting the front portion comprises the steps of positioning the front portion co-planar with a rear portion of the base in the extended position and supporting the front portion in the extended position on a first front arm of the first sidewall and on a second front arm of the second sidewall.

19. The method of claim 17, wherein the step of pivoting the first sidewall about the second hinge comprises aligning the first clip with the first aperture, and the step of pivoting the second sidewall about the third hinge comprises aligning the second clip with the second aperture.

20. The tray of claim 1, wherein the front portion overlaps the rear portion when in the retracted position.

* * * * *